United States Patent [19]

Newton et al.

[11] Patent Number: 4,826,120

[45] Date of Patent: May 2, 1989

[54] MOUNTING BRACKET

[75] Inventors: Brian L. Newton, Woonsocket, R.I.; Rino Conti, Stoughton, Mass.; Martin J. Wolff, North Providence, R.I.

[73] Assignee: Dart Industries Inc., Deerfield, Ill.

[21] Appl. No.: 85,915

[22] Filed: Aug. 17, 1987

Related U.S. Application Data

[63] Continuation-in-part of Ser. No. 846,684, Apr. 1, 1986, Pat. No. 4,762,237.

[51] Int. Cl.[4] ..... F16M 13/00

[52] U.S. Cl. ..... 248/221.4; 248/318; 248/224.4; 108/149

[58] Field of Search ..... 108/149, 94, 143; 312/246, 248, 245, 252; 248/221.4, 224.4, 224.2, 224.1, 318, 342, 343, 317, 302; 211/115, 113, 78, 131, 181, 106; 24/555, 545

[56] References Cited

U.S. PATENT DOCUMENTS

| | | | |
|---|---|---|---|
| 2,210,235 | 8/1940 | Filbert | 248/224.1 |
| 2,588,009 | 3/1950 | Jones | 248/224.2 X |
| 2,754,166 | 7/1956 | Ohm | 211/78 X |
| 3,004,370 | 10/1961 | Tinnerman | 403/397 X |
| 3,055,686 | 9/1962 | Havener | 403/397 X |
| 3,379,399 | 4/1968 | Kennedy | 248/312 |
| 4,441,583 | 4/1984 | Vaught | 211/113 X |
| 4,544,119 | 10/1985 | Kellett et al. | 248/221.4 X |

FOREIGN PATENT DOCUMENTS

| | | | |
|---|---|---|---|
| 2944748 | 5/1981 | Fed. Rep. of Germany | 24/545 |

*Primary Examiner*—Kenneth J. Dorner
*Assistant Examiner*—José V. Chen
*Attorney, Agent, or Firm*—John A. Doninger

[57] ABSTRACT

A mounting bracket comprising a horizontal base with a pair of laterally spaced upwardly directed mounting arms terminating in spaced relation above the base in a pair of laterally outwardly formed downwardly directed elongate mounting channels. A pair of lugs are interposed in each channel along the length thereof and cooperate with the channel to define a snap-lock. A pair of oppositely directed support shoulders are integrally formed with the base and provide spaced coplanar support surfaces mounting opposed positioning ribs which cooperatively form a snap-lock retainer including converging forward portions and laterally enlarged rear seating portions. Retaining flanges are integrally formed with the base and depend therefrom into spaced overlying relation to the plane of the shoulder surfaces.

11 Claims, 3 Drawing Sheets

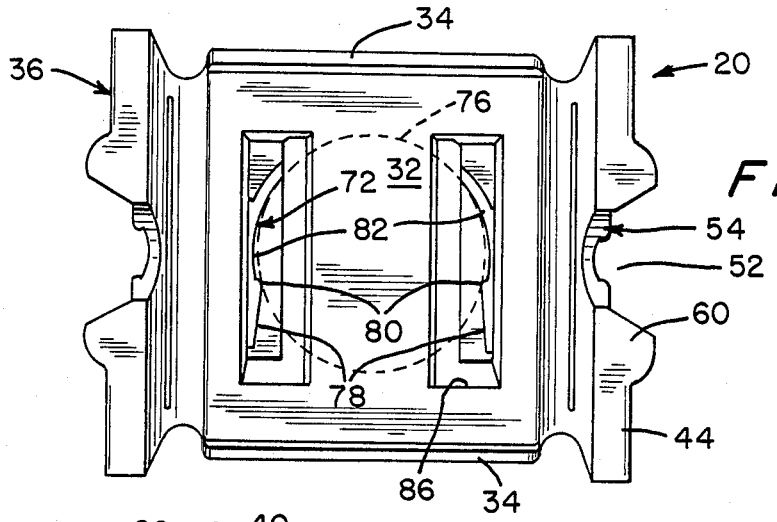
FIG. 4
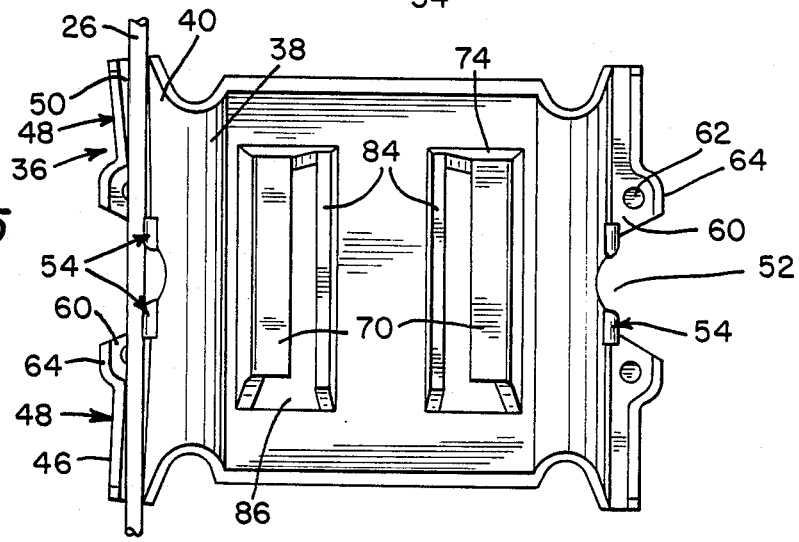
FIG. 5
FIG. 6
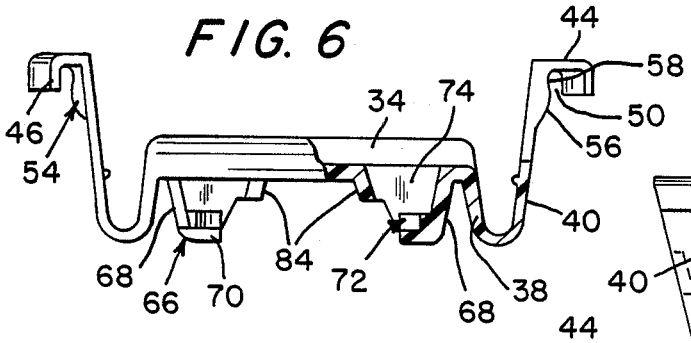
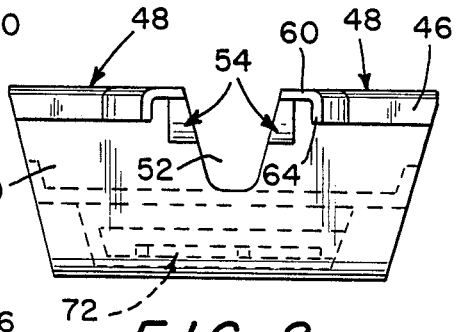
FIG. 8
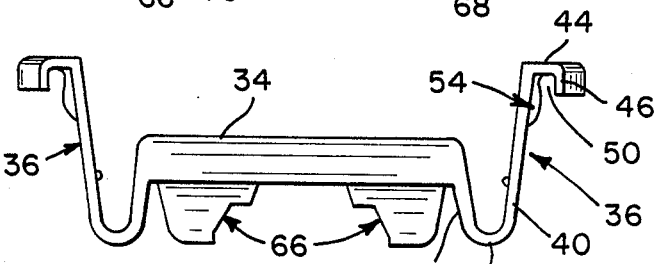
FIG. 7

FIG. 9
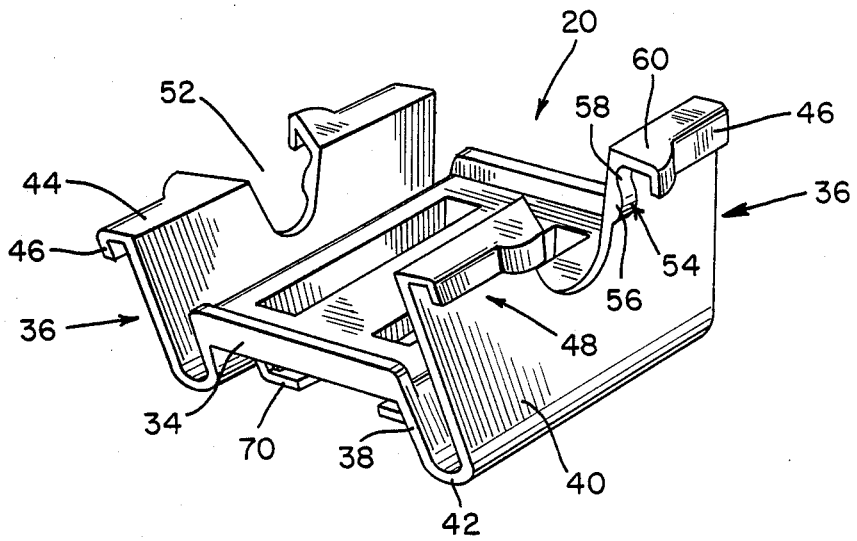
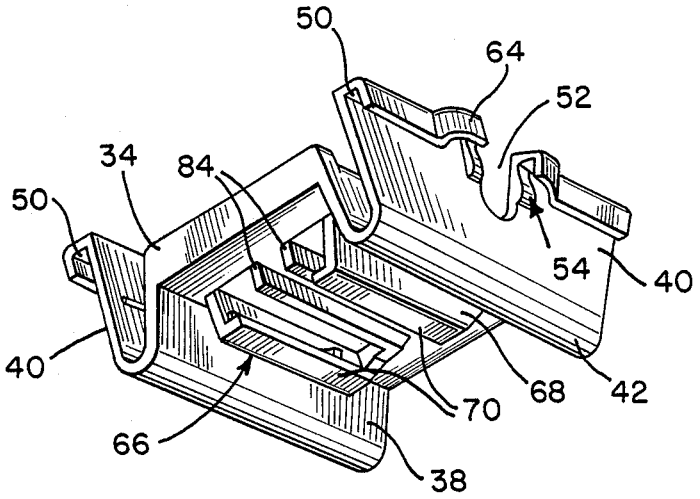
FIG. 10

MOUNTING BRACKET

This is a continuation-in-part of copending application Ser. No. 846,684, Brian L. Newton, filed Apr. 1, 1986, now U.S. Pat. No. 4,762,237.

BACKGROUND OF THE INVENTION

The necessarily compact interiors of refrigerators and like structures such as upright freezers and storage cabinets inherently give rise to problems with regard both to utilization of limited interior space to its maximum, and provision of convenient access to the stored items or goods. These problems are particularly acute in refrigerators which, under normal circumstances, will have goods introduced thereto and removed therefrom many times throughout the day. Further, in view of the conventional manner of stacking goods in and on relatively deep shelves, it is not unusual for the user of the refrigerator to remove or displace several items in order to obtain access to a particular item.

Various attempts have been made to facilitate the placement of goods within a refrigerator, in particular, for easy subsequent access thereto. For example, attention is directed to the following patents:

U.S. Pat. No. 1,687,149 Shauer et al Oct. 9, 1928
U.S. Pat. No. 2,070,055 Levien Feb. 9, 1937
U.S. Pat. No. 4,191,437 Funke Mar. 4, 1980

Each of these patents proposes a refrigerator storage system wherein one or more rotatable trays are mounted on a refrigerator shelf whereby goods may be accommodated on the tray and, through a rotation thereof, selectively moved to the rear of the refrigerator for storage or to the front of the refrigerator for direct unencumbered access thereto. In each of these cases, the rotatable tray is merely a substitute for the shelf surface itself and, while providing for an enhanced access to the goods stored within the refrigerator, probably reduces the effective storage space and does not address the problem of full utilization of the vertical space between the shelves of a refrigerator.

While not in a refrigerator environment, it has long been known, as exemplified by the following patents, to suspend turntable-like units from overhead supports, generally shelves:

U.S. Pat. No. 2,010,962 Reinsberg Aug. 13, 1935
U.S. Pat. No. 2,082,088, Wilson June 1, 1937
U.S. Pat. No. 2,431,837 Spotts et al Dec. 2, 1947
U.S. Pat. No. 2,525,538 Gamin Oct. 10, 1950
U.S. Pat. No. 2,754,166 Ohm July 10 1956

The majority of these patents provide for a direct bolting or screwing of the turntable assembly to the overhead of the turntable assembly to the overhead support, Reinsber does show, in one embodiment, the reliance on spring biased hook members.

Suspension means in the nature of hooks will also be noted in the following patent:

U.S. Pat. No. 1,684,558 Schwarz Sept. 18, 1928

In Schwartz, the hooks engage the pipes of the refrigerating unit of a refrigerator and in turn support shoulder members for receiving a drain pan.

The storage system of the parent application utilizes a mounting bracket specifically adapted to engage and depend from a refrigerator wire shelf or rack for the suspension of a tray therebelow. The bracket includes a pair of opposed arms which engage the wires of the shelf, and a pair of support shoulders which receive the enlarged head of the handle of a tray supported by the bracket.

SUMMARY OF THE INVENTION

The present invention proposes, in the basic storage system of the parent application, a mounting bracket uniquely improved for enhanced stability relative to both the standard wire racks or shelves found within refrigerators and tray assembly to be suspended from the bracket.

The storage system in its entirety includes the shelf engaging mounting bracket and a bracket-suspended tray assembly or lazy Susan. The bracket is specifically adapted to be manually manipulated for direct releasable locked engagement with the wires of a wire rack, relying solely on the structure of the bracket and without additional mechanical fasteners. The tray assembly slidably engages within the bracket and is retained therein for a support and rotatable presentation of goods.

The objects of the invention include the provision of a bracket which, when positioned and mounted on a wire rack, is effectively locked thereto against any possibility of movement during use of the storage system. Similarly, it is an object of the invention to provide a bracket which accommodates the enlarged head of the handle of a tray assembly suspended therebelow in a manner whereby the handle is effectively locked against slipping, shifting or any disruptive movement relative to the bracket upon manipulation or loading of the tray assembly during the normal course of use.

The improved bracket comprises an elongate planar base having mounting arms integral with the opposed edges thereof. Each mounting arm includes an inner depending portion or wall terminating, at the lower edge thereof, in a reversely turned elbow which integrally joins an upwardly directed and slightly outwardly flared outer portion or wall. The outer wall projects above the planar base and terminates in an outwardly directed flange having a depending outer retaining lip generally paralleling the adjacent wall and defining a wire-receiving channel therewith. Each of the outer walls is bifurcated or provided with a central notch inwardly through the upper portion thereof, through the support flange and associated retaining lip to define, in effect, a pair of aligned spaced fingers.

In order to accommodate the possibility of the bracket mounting to an overhead shelf of wood or the like by driven fasteners such as screws, each flange and associated lip is outwardly extended or enlarged to both sides of the notch. Each enlargement will include a "punch out" portion through which an upwardly directed screw can be introduced, and a rim defining an enclosure for the head of the screw.

The inner and outer walls of each mounting arm are, in the planes thereof, rigid and non-extensible to provide for a positive suspension means for the bracket and the tray suspended from the bracket. However, each arm, and in particular the relatively thinner outer wall thereof, is laterally flexible for a selective movement of the arms toward each other for introduction upwardly through the wires of a conventional refrigerator rack.

The lateral flexibility of the outer walls is also utilized as a means for enhancing a non-slipping engagement with the wires of an overhead rack. In regard thereto, a locking lug projects from the outer face of each outer wall to each side of the notch in general alignment with the rimmed enlargements. The lugs interrupt the linear extent of wire-receiving channels and define a snap-lock therewith, requiring a deformation of the channels through the lateral flexibility of the outer walls to engage the wires within the channels. This results in a positive snap-locking effect which provides a highly stable fixing of the bracket to the shelf.

In order to accommodate a tray assembly, the bracket includes a pair of depending opposed L-shaped supports integral with the base and extending longitudinally thereof. The L-shaped supports define a pair of spaced shoulders which receive and support an enlarged head on the handle of the tray assembly. The shoulders in turn are provided with opposed cooperating ribs between which the handle head is longitudinally received and snap-locked for a stable affixing of the handle on which the tray itself rotates. Retaining flanges overlie the received head and restrict vertical movement of the head to confine the head between the ribs.

As desired, the mounting bracket will preferably be injection molded as a single unit of high impact plastic.

The tray assembly to be supported on the bracket of the invention is basically that disclosed in the parent application and includes a base with an upwardly directed internally threaded axial socket and an annular bearing race. An annular bearing housing is positioned within the bearing race and in turn supports an overlying rotary platform for rotation relative to the base. The platform includes a central boss freely receiving the base socket therethrough. The rotary platform is retained on the base by the vertically elongate handle having a lower threaded shank end threaded within the internally threaded socket and an enlarged retaining collar overlying the boss whereby upward movement of the rotary platform relative to the base is precluded without limiting the free rotational movement of the platform. The upper end of the handle terminates in a disk-like or planar circular head which is in turn slidably received and snap-locked between the L-shaped supports of the mounting bracket in supported engagement on the opposed inwardly directed support shoulders of the bracket.

Other features of the mounting bracket of the invention, as well as further advantages derived from the particulars of construction, will become apparent from the detailed description of the invention following hereinafter.

The disclosure of parent application Ser. No. 846,684 is herein incorporated by reference.

BRIEF DESCRIPTION OF THE DRAWINGS

FIG. 4 is a top plan view of the bracket;

FIG. 5 is a bottom plan view of the bracket illustrating engagement of one mounting arm with a rack wire;

FIG. 6 is a front elevational view of the bracket with a portion in section;

FIG. 7 is a rear elevational view of the bracket;

FIG. 8 is a side elevational view of the bracket;

FIG. 9 is a top perspective view of the bracket; and

FIG. 10 is a bottom perspective view of the bracket.

DESCRIPTION OF THE PREFERRED EMBODIMENT

Figure 1:
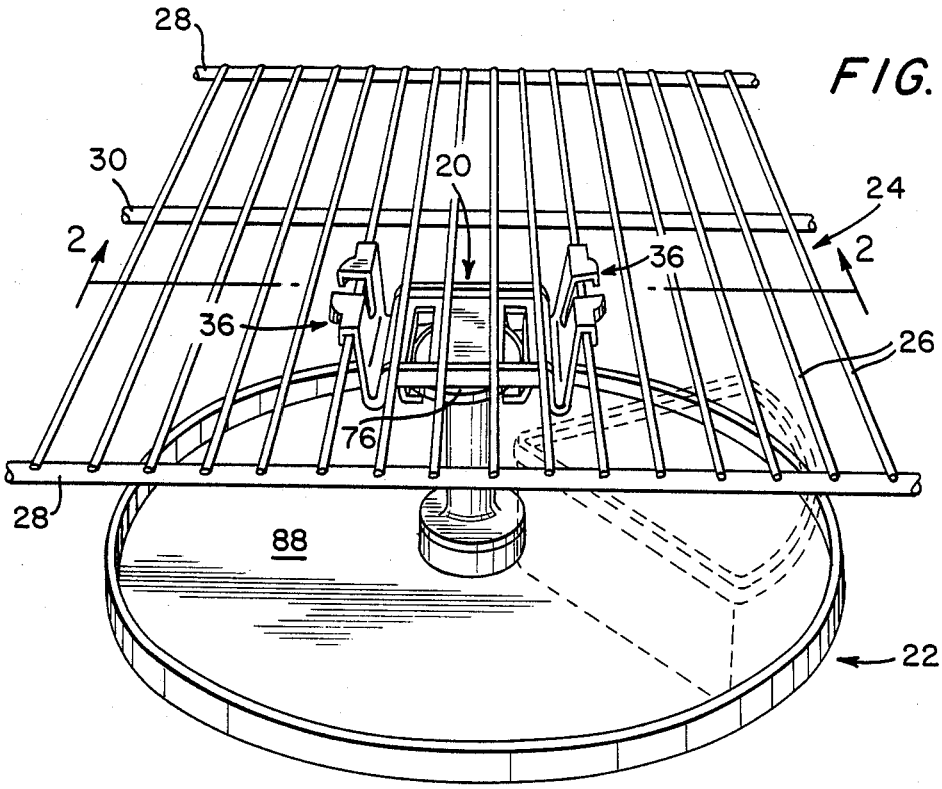
FIG. 1 is a perspective view of the storage system incorporating the mounting bracket of the present invention mounted on and depending from a wire rack or shelf of a refrigerator.

Referring now more specifically to the drawings, and as will be appreciated from FIG. 1, the mounting bracket 20 of the invention is particularly intended for use in the support of a rotating tray assembly 22 cooperatively engaged with the bracket 20.

The bracket 20 is specifically adapted to engage with and depend beneath a conventional refrigerator wire rack or shelf 24 of the type normally comprising multiple laterally spaced parallel elongate rigid wires 26 welded, at the opposed ends thereof, to transverse front and rear support rods 28. Such racks will also normally include one or more intermediate support rods 30 for a further stabilization of the wires 26. The bracket 20, preferably a single unit of injection molded high impact plastic, incorporates both means for engaging and locking to the refrigerator shelf 24, and means for receiving and securing the tray assembly 22 without the addition of separate mechanical fasteners or the like.

More particularly, the bracket 20 includes an elongate planar base 32 terminating at the front and rear ends thereof in upstanding reinforcing or rigidifying ribs 34, each extending transversely across the full width of the base 32.

A pair of elongate mounting arms 36 are integrally formed along the opposed longitudinal edges of the base 32. The arms 36 are oppositely directed duplicates of each other. Each arm 36 includes an inner portion or wall 38 integral with and both depending and slightly flaring outward from the corresponding longitudinal edge of the base 32. An outer portion or wall 40 generally parallels each wall 38 in outwardly spaced relation thereto and is integrally joined to the lower edge of the corresponding inner wall 38 by a U-shaped bend or elbow portion 42. Each outer wall 40 flares slightly outward relative to the corresponding inner wall 38 and terminates in an upper outwardly directed support flange 44 in spaced relation above both the base 32 and the support ribs 34 thereon. Each outwardly directed flange in turn terminates in an integral depending retaining lip 46 along the outer edge thereof, defining a wire-receiving channel 50. As illustrated, each outer wall 40 is bifurcated by a central notch 52 through the lip, flange and upper edge thereof to define a pair of aligned finger portions 48. Each finger portion 48 will include a corresponding portion of both the support flange 44 and the retaining lip 46. While not specifically illustrated, the bifurcated outer walls 40 will allow for a mounting of the bracket 20 in a position centrally underlying an intermediate support rod 30 of a refrigerator rack 24.

Figure 2:
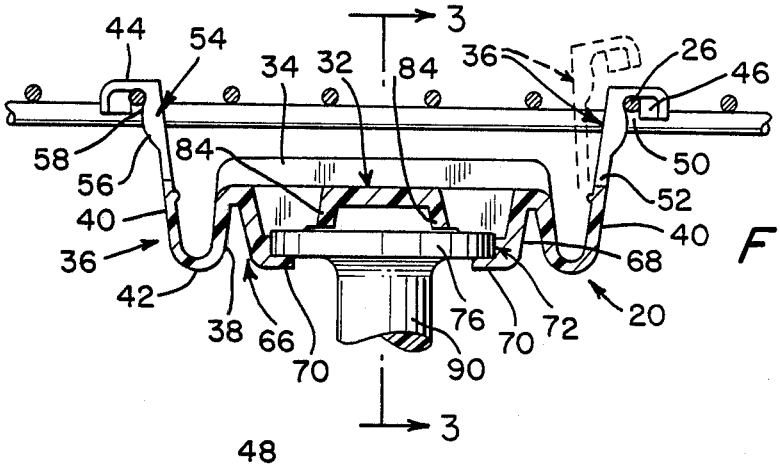
FIG. 2 is an enlarged cross-sectional detail taken substantially on a plane passing along line 2—2 in FIG. 1.

Noting the end elevational views of FIGS. 6 and 7, as well as the cross-sectional view of FIG. 2, it is contemplated that the outer walls 40 and the immediately adjoining section of the elbows or elbow portions 42, be relatively thinner than the inner walls 38 and capable of lateral and inward flexing upon the application of manual pressure thereto for a mounting of the bracket 20. This flexure, as suggested in FIG. 2, occurs principally in the outer walls 40, and to a substantially lesser degree in the elbows and inner walls 38. Such flexure is made possible by the inherent nature of the material of the bracket 20 and is resiliently resisted with the memory characteristics of the material returning the mounting arms 36 to their original positions upon release of the pressure. The basically rigid nature of the inner and outer walls, and associated flanges 44 and retaining lips 46, provides for a stable mounted bracket, notwithstanding the ability to laterally resiliently flex for mounting and removal purposes in the manner suggested in FIG. 2.

In order to enhance locking of the bracket 20 to corresponding pair of wires 26 against either lateral or longitudinal shifting thereon, the outer face of each outer wall 40 is provided with a pair of outwardly directed lugs 54 integrally formed therewith and extending downwardly from the corresponding flange 44 immediately to each side of the central notch 52. Each lug 54 includes an outer surface with a generally ogee configuration including a convex lower portion 56 and a slightly concave or recessed portion 58 immediately thereabove and adjacent the undersurface of the overlying flange 44. Thus configured, the upper recessed portion 58 of the lug 54, in conjunction with the channel 50, forms an effective wire seating and retaining recess.

Noting in particular FIG. 5, the lugs 54 project to extend into the linear extent of the associated channel 50.

In outward slightly longitudinally offset alignment with each of the lugs 54, the channel-defining flange 44 is outwardly enlarged to define an auxiliary fastener receiving portion 60 incorporating a central punch-out area 62 through which a driven fastener can be extended. In this manner, provision is also made for an alternate securing of the bracket to a solid overhead support, such as a wooden shelf. Each fastener-receiving portion 60 is rigidified by an arcuate outer rim 64 comprising an integral continuation of the adjacent portion of the lip 46. This rim will also provide aesthetically pleasing enclosure for the head of a driven fastener.

The provision of an outwardly enlarged portion 60 generally aligned with each of the lugs 58 facilitates the flexing of the aligned finger portions to accommodate an inward snapping of the corresponding wire 26 over the convex portions 56 of the associated lugs 54. In this regard, note the left side of the bracket illustrated in FIG. 5.

With reference to FIG. 2, the bracket 20, through the laterally inward resilient flexing of the mounting arms 36, can be easily upwardly inserted through the wires 26 of a refrigerator rack 24 with the arms allowed to outwardly move to position the support flanges 46 and downwardly directed channels 50 in overlying relation to adjoining ones of the wires 26. A subsequent forceful downward movement of the bracket arms 36 will seat the wires 26 in the channels 50 with a snap-lock effect. As suggested in FIGS. 2 and 5, the wires 26 will engage against the curved outer faces of the relatively rigid lugs 54 and, as the wires 26 move into the channels 50, cause a lateral twisting of the channel defining flanges 44 and lips 46 to accommodate the wires in a locked position.

When each wire 26 is fully seated within the corresponding channel 50, outward movement of the wire 26 relative to the channel 50 is effectively resisted by the convex configuration of the lower portions 56 of the lug faces and the wire-receiving recesses defined immediately thereabove. In addition, substantial frictional resistance to relative movement of the bracket along the wires is developed by the lateral twisting of the channels which, as suggested in FIG. 5, produce distinct longitudinally offset bearing points defined by the lugs and the opposed lips, particularly at the juncture of the outwardly enlarged fastener portions. Each wire is locked within the corresponding channel by at least four pressure points resiliently biased thereagainst as a result of the lateral flexing of the channel-forming components effected by a forcing of the wire therein. Thus, once the bracket 20 is seated on the corresponding wires 26, shifting of the bracket relative to the wires of the rack 24 in any direction will be effectively precluded by the frictional gripping of the wires by the bracket.

It is also to be appreciated that the ability of the mounting arms 46 to inwardly flex provides for an accommodation of the bracket 20 to variations in wire spacing, wire size, and the like, thus providing in effect a universal bracket. The versatility of the bracket is increased by the enlarged fastener portions which can selectively accommodate mounting screws or like driven fasteners engaged upwardly therethrough and into fixed engagement with an overlying solid shelf, for example a wooden shelf within a kitchen cabinet.

In order to receive and accommodate the tray assembly 22, the mounting bracket 20 is provided with support means comprising a pair of laterally spaced, parallel, oppositely directed L-shaped supports 66 integral with and extending longitudinally along a major portion of the base 32 in depending relation thereto. The supports 66 include elongate side walls 68 depending from upper edges integral with the base 32 and integral inwardly directed full length support shoulders 70 along the lower edges of the side walls. The shoulders 70 define an access slot therebetween and mount a pair of opposed positioning ribs 72 integrally molded on the upper surfaces thereof.

The opposed L-shaped supports 66 open forwardly or toward the front of the bracket for the accommodation of a corresponding portion of the tray assembly as shall be explained presently. Each of the associated supports 66 in turn includes an inner end wall 74 which functions as a means for stabilizing the support shoulders 70.

Noting FIGS. 4 and 6 in particular, the ribs 72 on the respective shoulders 70 include facing vertical surfaces for the selective reception of the disc-shaped handle head 76 of the tray assembly 22 therebetween. Accordingly, the opposed faces of the opposed ribs 72, immediately inward of the front of the bracket 20, have laterally inward converging portions 78 which provide camming surfaces inwardly guiding the handle head 76. These opposed converging portions 78, at the outer or forward ends thereof, are spaced so as to closely yet freely receive the head 76 therein. As the portions 78 converge inwardly to opposed inner ends 80, the transverse spacing therebetween ultimately is less than the diameter of the head 76, thus providing for an increasing frictional resistance to inward movement of the head between the ribs 72.

Each of the ribs 72, immediately inward of the inner ends 80 of the converging entry portion 78 thereof, includes a concave seating portion 82 laterally recessed relative to the inner ends 80. The opposed recess portions 82 define a circular configuration with a diameter greater than the transverse distance between the inner ends 80 and equal to or minutely greater than the diameter of the tray assembly head 76. The arcuate extent of the recess defined by the opposed recessed portions 82 is slightly greater than 180 whereby a positive snap-locking of the head 76 therein will be achieved upon a manual forcing of the head beyond the restrictive ledges defined at and by the ends 82. It is to be appreciated that the bracket, and in particular the L-shaped supports 66, will inherently incorporate the degree of resilient flexibility needed to accommodate the inward movement of the head 76.

Figure 3:
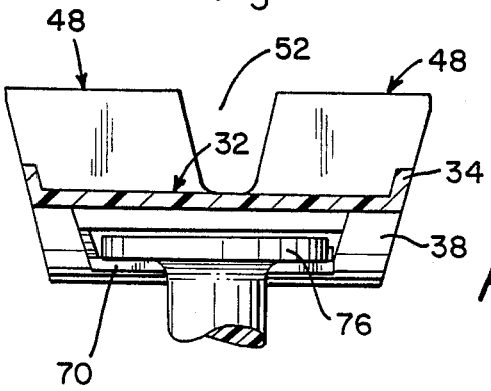
FIG. 3 is a cross-sectional detail of the bracket taken substantially on a plane passing along line 3—3 in FIG. 2.

In order to preclude any tendency for the tray assembly head 76 to vertically shift above the opposed retaining ribs 72, a pair of depending retaining flanges 84 are integrally molded with the base 32 and depend centrally therefrom in laterally spaced parallel relation to each other between and parallel to said shoulders 70. These retaining flanges are of generally equal length with the shoulders 70 and similarly extend from front to rear on the bracket. The coplanar lower edges of the retaining flanges 84 are spaced above the plane of the upper support surfaces of the shoulders 70 a vertical height closely approximating the thickness of the head 76 for a close but free sliding reception of the head therebetween whereby vertical shifting of the head 76, seated within the recessed portions, is precluded. In this manner, the head 76 is effectively retained between the ribs 72 and any tilting or vertical shifting of the head, such as might accidentally release the head from the retaining ribs, is effectively precluded. The relationship between the retaining flanges 84, tray head 76 and support shoulders 70 will be best appreciated in FIGS. 2 and 3.

As will be noted from the drawings, the base 32 includes a pair of spaced holes or elongate slots 86 therein aligned with and over the L-shaped supports 66. Such holes or slots, particularly when a relatively low refrigerator shelf or rack is involved, will provide for a visual viewing of the insertion of the corresponding portion of the tray assembly and thereby aid in the proper location or orientation thereof. The retaining flanges 84, as illustrated, will depend from the respective lateral inner edges of the slots 86, generally paralleling the side walls 68 of the supports 66 outwardly spaced therefrom.

The tray assembly 22 releasably engages the mounting bracket 20 in a manner whereby the assembly 22 is supported solely from the overlying rack or shelf, providing a separate support platform in addition to the conventionally providing refrigerator shelves or racks.

The tray assembly 22 basically duplicates the tray assembly of the parent application and similarly includes a support platform 88 rotatable about a central support handle 90. The upper end of the handle 90, or more particularly the shaft thereof, terminates in the circular or disc-like flat head 76 which constitutes the means of releasably engaging the tray assembly 22 with the mounting bracket 20.

Noting FIG. 2, the shaft of the handle 90 is of a size which is easily received through the slot defined between the opposed inwardly directed support shoulders 70. The enlarged head 76, in turn, is of a substantially greater diameter than the width of the slot and, after introduction of the shaft through the open forward end defined by the opposed L-shaped supports 66, seats on the upper surfaces of the shoulders 70, snap-locked within the opposed recessed portions 82 of the ribs 72 configured to receive and closely conform to the head 76. The combination of the recessed portions 82 and the overlying retaining flanges 84 ensure a proper positioning and retention of the handle head 76 centrally within the mounting bracket 20 for a proper balanced support thereof.

Notwithstanding the highly stable rigid interlock between the bracket and the shelf wires, the mounting bracket 20, and hence the entire storage assembly, can be easily removed through merely a quick manual manipulation of the mounting bracket itself. As such, the storage assembly can be moved from one refrigerator shelf to another as desired, thus allowing for a substantial instantaneous rearrangement of the internal storage capacity of a refrigerator. Similarly, the snap-lock mounting of the handle head, while providing a positive non-shifting engagement, also provides for a simple manual release of the tray assembly for independent use thereof.

I claim:

1. For use in a storage system for engagement with and suspension from an overhead structure, a mounting bracket for mounting and supporting a tray assembly in depending relation thereto, said mounting bracket comprising a horizontal base having opposed side edges, a pair of oppositely directed mounting arms, one arm on each of said side edges, each are terminating in spaced relation above said base in a laterally outwardly directed mounting flange, a depending lip integral with each flange in outwardly spaced relation to the corresponding arm and defining a downwardly opening channel, each of said mounting arms including an inner wall depending from the corresponding side edge of said base, an outer wall in outwardly spaced generally parallel relation to said inner wall, and joinder means interconnecting the respective lower edges of each inner wall and the corresponding outer wall, each outer wall being inherently resiliently laterally flexible, each of said outer walls is transversely bifurcated, defining a pair of coplanar finger portions with a notch therebetween, a retaining lug integral with each outer finger portion immediately adjacent said notch, each lug extending transversely inward of the corresponding channel and defining a projection therein, each of said channels is of a greater width outward of and in general alignment with each of said lugs, each lug is vertically elongate and includes a lower convex portion and an upper recessed portion immediately adjacent the overlying flange, support means integral with said base and in underlying relation thereto for releasable supporting engagement with the tray assembly, said support means includes an opposed pair of L-shaped supports in spaced parallel underlying relation to said base, said L-shaped supports including side walls depending from said base and shoulders extending inwardly from said side walls, said shoulders including coplanar horizontal support surfaces, and a pair of opposed positioning ribs, one of said positioning ribs integrally formed on each of said support surfaces, said shoulders defining an elongate access slot therebetween, said bracket having a forward end, said shoulders and defined access slot extending longitudinally inward of said bracket forward end, and said positioning ribs comprising snap-lock means opening forwardly relative to the bracket forward end.

2. The mounting bracket of claim 1 wherein said snap-lock means are defined by forward portions and rear portions on said ribs, said forward portions converging rearwardly and having inner extremities, said rear portions being outwardly concave relative to the inner extremities of the forward portions.

3. The mounting bracket of claim 2 wherein said rearward portions define a pair of opposed partially circular recesses.

4. The mounting bracket of claim 3 including an elongate retaining flange integral with said base and depending therefrom between said shoulders, said retaining flange including a planar lower edge vertically space above and generally parallelling the plane of the support surfaces of said shoulders.

5. The mounting bracket of claim 4 including a second retaining flange duplicating said first mentioned retaining flange in laterally spaced parallel relation thereto.

6. For use in a storage system for engagement with and suspension from an overhead structure, a mounting bracket for mounting and supporting a tray assembly in depending relation thereto, said mounting bracket comprising a horizontal base having opposed side edges, a pair of oppositely directed mounting arms, one arm on each of said side edges, each arm terminating in spaced relation above said base in a laterally outwardly directed mounting flange, a depending lip integral with each flange in outwardly spaced relation to the corresponding arm and defining a downwardly opening channel, each of said mounting arms including an inner wall depending from the corresponding side edge of said base, an outer wall in outwardly spaced generally parallel relation to said inner wall, and joinder means interconnecting the respective lower edges of each inner wall and the corresponding outer wall, each outer wall being inherently resiliently laterally flexible, support means integral with said base and in underlying relation thereto for releasable supporting engagement with the tray assembly, said support means includes an opposed pair of L-shaped supports in spaced parallel underlying relation to said base, said L-shaped supports including side walls depending from said base and shoulders extending inwardly from said side walls, said shoulders including coplanar horizontal support surfaces, and a pair of opposed positioning ribs, one of said positioning ribs integrally formed on each of said support surfaces, said shoulders defining an elongate access slot therebetween, said bracket having a forward end, said shoulders and defined access slot extending longitudinally inward of said bracket forward end, and said positioning ribs comprising snap-lock means opening forwardly relative to the bracket forward end.

7. The mounting bracket of claim 6 including an elongate retaining flange integral with said base and depending therefrom between said shoulders, said retaining flange including a planar lower edge vertically space above and generally parallelling the plane of the support surfaces of said shoulders.

8. The mounting bracket of claim 7 wherein said snap-lock means are defined by forward portions and rear portions on said ribs, said forward portions converging rearwardly and having inner extremities, said rear portions being outwardly concave relative to the inner extremities of the forward portions.

9. For use in a storage system for engagement with and suspension from an overhead structure, a mounting bracket for mounting and supporting a tray assembly in depending relation thereto, said mounting bracket comprising a horizontal base having opposed side edges, a pair of oppositely directed mounting arms, one arm on each of said side edges, each arm terminating in spaced relation above said base in a laterally outwardly directed mounting flange, and support means integral with said base and in underlying relation thereto for releasable supporting engagement with the tray assembly, said support means including an opposed pair of L-shaped supports in spaced parallel underlying relation to said base, said L-shaped supports including side walls depending from said base and shoulders extending inwardly from said side walls, said shoulders including coplanar horizontal support surfaces, and a pair of opposed positioning ribs, one of said positioning ribs integrally formed on each of said support surfaces, said shoulders defining an elongate access slot therebetween, said bracket having a forward end, said shoulders and defined access slot extending longitudinally inward of said bracket forward end, and said positioning ribs comprising snap-lock means opening forwardly relative to the bracket forward end.

10. The mounting bracket of claim 9 wherein said snap-lock means are defined by forward portions and rear portions on said ribs, said forward portions converging rearwardly and having inner extremities, said rear portions being outwardly concave relative to the inner extremities of the forward portions.

11. The mounting bracket of claim 10 including an elongate retaining flange integral with said base and depending therefrom between said shoulders, said retaining flange including a planar lower edge vertically space above and generally parallelling the plane of the support surfaces of said shoulders.

* * * * *